US005782704A

United States Patent [19]

Tetler et al.

[11] Patent Number: 5,782,704

[45] Date of Patent: Jul. 21, 1998

[54] GOLF CLUB HOLDER

[76] Inventors: Sean D. Tetler; Christopher P. Tetler, both of 124 Hillside Rd., North Andover, Mass. 01845

[21] Appl. No.: 873,548

[22] Filed: Jun. 12, 1997

[51] Int. Cl.[6] ..... A63B 55/10

[52] U.S. Cl. ..... 473/282; 211/70.2; 248/121; 248/251; 248/688

[58] Field of Search ..... 473/282, 286, 473/408; 248/76, 86, 511, 121, 251, 688; 211/70.2

[56] References Cited

U.S. PATENT DOCUMENTS

| | | | |
|---|---|---|---|
| D. 279,309 | 6/1985 | Rosen et al. . | |
| D. 335,695 | 5/1993 | Beck . | |
| 3,014,595 | 12/1961 | Bartmann | 211/70.2 |
| 3,698,110 | 10/1972 | Shettel | 38/107 |
| 4,616,749 | 10/1986 | Briggs . | |
| 4,819,939 | 4/1989 | Kobayashi | 473/299 |
| 5,127,530 | 7/1992 | Ortuno . | |
| 5,230,507 | 7/1993 | White et al. . | |
| 5,269,410 | 12/1993 | Abregano | 206/315.5 |
| 5,417,334 | 5/1995 | Wu | 311/70.2 |
| 5,437,449 | 8/1995 | Zink . | |

*Primary Examiner*—Sebastiano Passaniti
*Assistant Examiner*—Stephen L. Blau
*Attorney, Agent, or Firm*—O'Connell Law Firm

[57] ABSTRACT

A device for supporting a golf club includes a generally rigid and elongate support member for providing an angular support for a golf club to be supported. A rubber shaft clamp with a channel for receiving and gripping a shaft portion of a golf club is attached to a first end of the support member while a cross member is attached generally perpendicularly to a second end of the support member for providing lateral support for the support device and the golf club when they are coupled together. A spring clip permits attachment of the support device to a golf bag. The spring clip also detachably retains a ball mark repair tool. A spike wrench is formed integrally with a first end of the cross member while a cleaning brush is coupled to a second end of the cross member. A portion of the support member is surrounded by a rubber sleeve to provide an improved grip on the support device.

13 Claims, 2 Drawing Sheets

GOLF CLUB HOLDER

FIELD OF THE INVENTION

The present invention relates generally to accessories for the sport of golf. More particularly, it relates to a golf club holder for supporting a grip portion of a golf club above a surrounding portion of ground.

BACKGROUND OF THE INVENTION

In playing golf, often it is necessary for a golfer to carry a number of clubs separately from the golfer's complete bag of clubs. One common instance arises when a golfer's ball is near but not on a putting green of a given golf hole. In such a case, the player normally will leave his or her golf bag behind in favor of carrying just the clubs required by the particular circumstances. For example, he or she may carry a chipping or sand wedge and a putter. Since the player can swing just one club at a time, he or she must first rest the putter in the grass or sand while endeavoring to get the ball onto the green with the wedge, and then he or she must rest the wedge on the grass while putting. Another common instance of a golfer carrying more than one club separately from his or her golf bag arises when a golfer approaching a ball on a fairway cannot determine the best suited club for the necessary shot until he or she reaches the ball and evaluates a number of factors such as the lie of the ball and the distance to the pin. As a result, he or she must carry two or more potentially useful clubs to where the ball lies and must lay the unused club on the grass while swinging a chosen, or active, club.

Laying one's clubs on golf course grass or sand without support often gives rise to one or more of a multiplicity of problems. For example, laying a club on the grass, dirt, or sand of a golf course often causes the grip portion of the club to become tainted with moisture and dirt. Since properly gripping the club is integral to a good golf shot, a wet or dirty grip is highly undesirable. While a well-prepared golfer who carries a club cleaner will merely be inconvenienced by having to clean and dry the grip, other golfers will be forced to play under far less than optimal conditions. Another prevalent problem that derives from laying one's club on the ground is that the club often is effectively shielded from the player's sight. Often, a club which is out of sight quickly fades from the focused golfer's mind and is forgotten where it lies. For obvious reasons, as the player moves on to the next and succeeding holes, the inconvenience of retrieving the forgotten club and the likelihood of permanently losing the club increase exponentially. Laying a golf club on the ground is disadvantageous for the still further reason that bending over to retrieve such a club is an inconvenience to all and a potentially difficult challenge to elderly and disabled players.

Although important, the difficulties presented by a golf club lying flat on the grass of a golf course is not the only issue that golfers must encounter. For example, to clean the faces of their clubs and the bottoms of their shoes, golfers often carry a stiff brush. Furthermore, many golfers will carry a spike wrench to maintain their spiked shoes. Still further, it is proper etiquette and good practice for a golfer to carry and use a ball mark repair tool to repair marks left by the player's dropping ball and to repair damage to the putting green along the player's anticipated putting line. Transporting such a multiplicity of these and other golf accessories can present a cumbersome and frustrating task.

In light of the above, it becomes clear that there is a need in the art for a simple yet effective golf club holder that supports the grip portion of a golf club above a surrounding portion of ground to prevent a loss of the club, to avoid water or dirt from affecting the club's grip, and to ease a player's retrieval of the club. There is a still greater need for a golf club holder that further incorporates other golf club accessories thereby easing the transportation of and the accessibility to a multiplicity of golf accessories.

SUMMARY OF THE INVENTION

Advantageously, a principal object of the present invention is the providing of a golf club holder that simply and effectively holds a grip portion of a golf club above a surrounding portion of ground.

A resultant object of the present invention is to keep the grip portion of the golf club clean and free of moisture thereby to allow a golfer employing the invention to have an optimal grip on the club.

Another goal of the invention is to keep a golf club that must be rested on the golf course grounds within a golfer's view thereby to prevent a loss of the club.

Yet another object of the invention is to provide a device that frictionally attaches to a golf club to be supported whereby the device is lifted when the golf club is lifted thereby to ease a golfer's retrieval of his or her club.

A further object of the invention is to incorporate a multiplicity of golf accessories into a single, readily accessible device thereby to simplify and improve a golfer's game.

An underlying object of the invention is to provide a compact and unobtrusive device that accomplishes all of the aforementioned objects simultaneously.

In accomplishing the aforementioned objects, the present invention is comprised essentially of a generally rigid and elongate support member, a shaft clamp attached to a first end of the support member, a channel in the shaft clamp aligned with the support member for receiving and gripping a shaft portion of a golf club to be supported to prevent sliding relative thereto, and a means for providing lateral support to a second end of the support member. Although the lateral support means may take a number of forms, one preferred form is that of an elongate cross member. Taking advantage of this basic embodiment of the invention, a user may insert a shaft portion of a golf club into the channel of the shaft clamp thereby causing the device to support the golf club and to maintain the grip portion of the golf club above a surrounding portion of ground. As a result, the golfer employing the invention is less likely to forget a golf club because the club is supported in an easily visible position. Furthermore, the grip portion of the club is prevented from becoming wet or soiled. Further still, a user can retrieve the golf club easily since it is maintained in a generally upright state.

An ideal golf club support device will have a shaft clamp that is formed of a resilient material that exhibits a high coefficient of friction so that a golf club may be pressed into the channel of the shaft clamp and be held frictionally to prevent sliding between the golf club and the golf club support device. For example, rubber, preferably hard but resilient vulcanized rubber, has been found to exhibit a resilient gripping ability in an exemplary manner. This frictional coupling of the club and the support device ensures a secure and reliable supporting relationship that prevents the golf club from falling. The frictional coupling also permits a simultaneous lifting of the golf club and the golf club support device thereby further easing the use of the device and the support of a golf club.

A number of variations to the basic golf club support device are contemplated that make the device still more useful and convenient. For example, the device may include further a means, such as a spring clip, for removably attaching the device to a golf bag. Also, a spike wrench may be coupled with a first end of the cross member, a cleaning brush may be coupled with the second end of the cross member, and a ball mark repair tool may be removably coupled with the device by, for example, the spring clip. With these three traditional golf accessories incorporated into the golf club support device of the present invention, four markedly different but immensely useful tasks can be accomplished with a single, readily accessible device.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION

Figure 1:
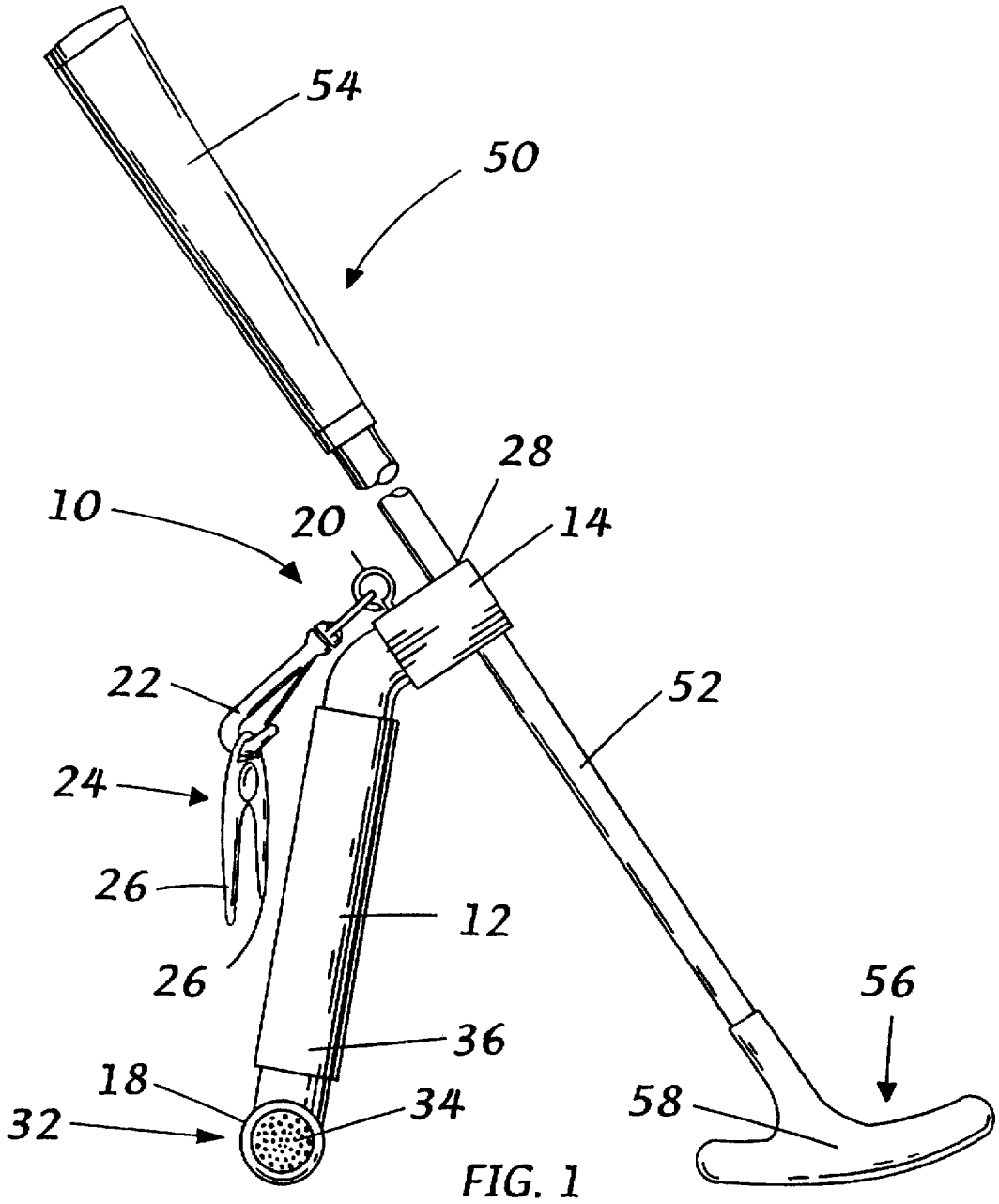
FIG. 1 is a view in side elevation of a golf club support device according to the present invention.
Figure 3:
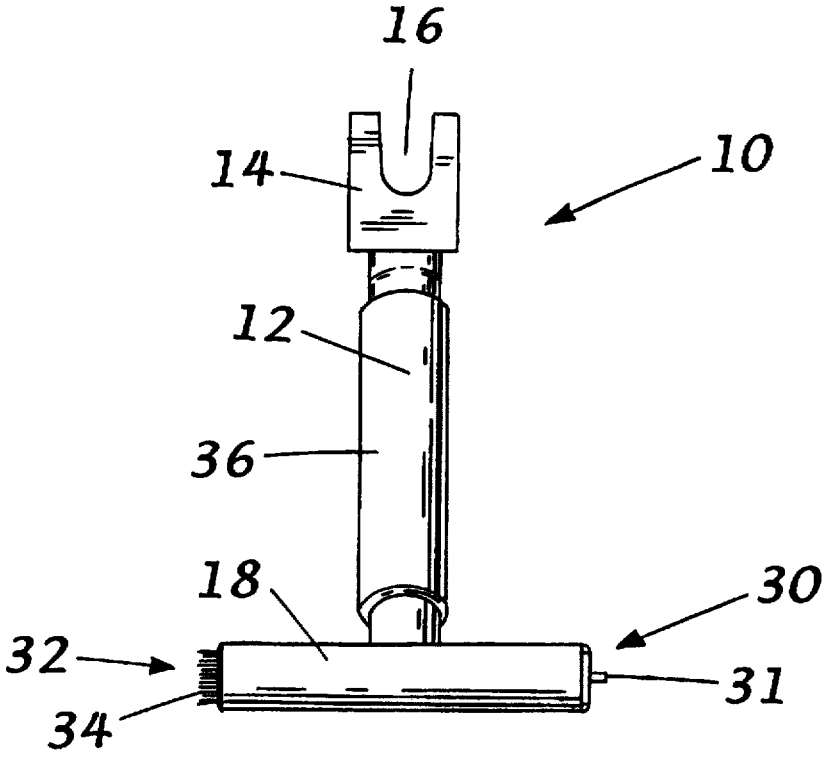
FIG. 3 is a bottom plan view of the golf club support device of FIG. 1.

Referring more particularly to FIG. 1, there is indicated generally at 10 a preferred embodiment of the golf club support device according to the present invention. The support device 10 has a generally rigid and elongate support member 12. A shaft clamp 14 is attached to a first end of the support member 12. The shaft clamp 14 functions as a means for clamping the support device 10 to a shaft portion 52 of a golf club 50. As is best seen in FIG. 3, the shaft clamp 14 has a channel 16 in it. The channel 16 is aligned with the support member 12 and is sized appropriately for receiving and gripping the shaft portion 52 of the golf club 50 that is to be supported. As a means for providing lateral support to the golf club 50 and the support device 10, a cross member 18 is attached generally perpendicularly to a second end of the support member 12. The support member 12 and the cross member 18 may be tubular and should be formed of any appropriately strong and durable material. However, for combined lightness and strength, ideal materials are plastics such as polyethylene, polyvinyl chloride (PVC), polystyrene, and polyester. Although the shaft clamp 14 might be crafted from a variety of appropriate materials, it has been discovered that it may be most preferable to form the shaft clamp 14 from vulcanized rubber to ensure a secure frictional connection between the golf club 50 and the support device 10.

As is shown in FIG. 1, in using the support device 10, a golfer may press a shaft portion 52 of a golf club 50 into the channel 16 of the shaft clamp 14 to create a frictional coupling point 28 of the golf club 50 and the support device 10. Coupled together, the support device 10 and the golf club 50 may be placed on a portion of ground in a mutually-supporting relationship wherein what might be called a support triangle is formed with a head 56 of the golf club 50 and the cross member 18 on the ground forming bottom corners and the coupling point 28 of the shaft clamp 14 and the golf club 50 forming an apex.

The resiliency and frictional characteristics of the rubber shaft clamp 14 ensure a secure, reliable, and mutually-supporting relationship between the support device 10 and the golf club 50. As a result, by the angular relationship of the support device 10 and the golf club 50 and by the lateral support that is provided by the cross member 18, the golf club 50 is effectively prevented from falling down or over. The frictional coupling also permits one taking advantage of the invention to retrieve both the golf club 50 and the support device 10 with no need to bend. Still further, the gripping properties of the shaft clamp 14 permit the support device 10 to be compact in length, less than eight inches from a distal tip of the shaft clamp 14 to a distal edge of the cross member 18 in the preferred embodiment. It has also been discovered that a cross member 18 with a length of about four inches from end to end provides optimal lateral stability without unduly increasing the overall weight or size of the support device 10.

A loop 20 is attached to the support member 12. Hooked onto the loop 20 is a spring hook 22 for hooking the support device 10 onto an object such as a golf bag (not shown). This preferred embodiment of the support device 10 further includes a ball mark repair tool 24 that is removably hooked onto the spring hook 22. The ball mark repair tool 24 has a pair of prongs 26. In use, a golfer may remove the ball mark repair tool 24 from the spring hook 22 and use the tool 24 to repair ball marks and other blemishes on a putting green (not shown) in a manner well known to the art.

Figure 2:
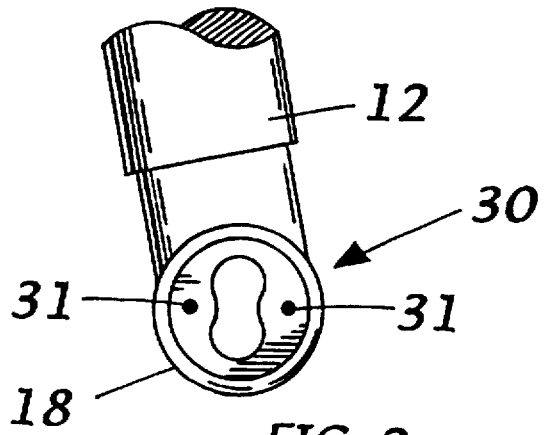
FIG. 2 is a view in side elevation of the spike wrench portion of the golf club support device of FIG. 1.

Looking for most clear reference to FIG. 2, innovatively included with the support device 10 is a spike wrench 30. In this preferred embodiment, the spike wrench 30 is formed integrally with the support device 10 at a first end of the cross member 18. The spike wrench 30 has a pair of rods 31 for matingly engaging corresponding holes found in the spikes of golf shoes (not shown). Consequently, the spike wrench 30 may be accessed easily by a golfer to tighten spikes on the golfer's shoes in a manner well known to the art.

Looking again to FIG. 1, one sees that this preferred support device 10 further includes a cleaning brush 32 attached to a second end of the cross member 18. The cleaning brush 32 is comprised of a multiplicity of bristles 34. As with the ball mark repair tool 24 and the spike wrench 30, the cleaning brush 32 is easily accessed by a golfer who takes advantage of the invention to enable the golfer to clean such surfaces as the golfer's shoes (not shown) or a face 58 of the head portion 56 of golf club 50. In these applications of the support device 10, the support member 12 may act as a convenient handle for the spike wrench 30 and the cleaning brush 32. For this and other purposes, a rubber sleeve 36 surrounds support member 12 to provide a user with a sure grip on the supportive device 10.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as protected by Letters Patent of the United States:

1. A device for supporting a golf club by engaging a shaft portion of the golf club to maintain a grip portion of the golf club that is located along the shaft portion of the golf club above a surrounding portion of ground on which a head portion of the golf club rests, the golf club support device comprising:

a generally rigid and elongate support member for providing an angular support for a golf club to be supported wherein the support member comprises a single tubular member with a first end and a second end;

a shaft clamp attached to the first end of the support member;

a channel in the shaft clamp aligned with the support member for receiving and gripping the shaft portion of a golf club to be supported; and a means connected to the support member for providing lateral support to the device;

whereby the shaft portion of a golf club may be supported by the device to maintain the grip portion of the golf club above a surrounding portion of ground thereby supporting the golf club in an easily visible position, preventing the grip portion of the club from becoming wet or soiled, and easing retrieval of the golf club.

2. The golf club support device of claim 1 wherein the shaft clamp is resilient whereby the shaft portion of a golf club to be supported may be pressed into the channel to open the channel whereby there is provided an improved frictional coupling of the shaft clamp with the shaft portion of the golf club thereby improving support of the golf club and ensuring that a lifting of the golf club will tend to lift the golf club support device simultaneously.

3. The golf club support device of claim 2 wherein the shaft clamp is formed from rubber.

4. The golf club support device of claim 3 wherein the shaft clamp is formed from vulcanized rubber.

5. The golf club support device of claim 2 further comprising a means coupled to the device for removably attaching the device to a golf bag.

6. The golf club support device of claim 5 wherein the removable attaching means is comprised of a spring clip.

7. The golf club support device of claim 1 wherein the lateral support means comprises a cross member attached generally perpendicularly to the second end of the support member wherein the cross member has a first end and a second end.

8. A device for supporting a golf club by engaging a shaft portion of the golf club to maintain a grip portion of the golf club that is located along the shaft portion of the golf club above a surrounding portion of ground on which a head portion of the golf club rests the golf club support device comprising:

a generally rigid and elongate support member for providing an angular support for a golf club to be supported wherein the support member has a first end and a second end;

a shaft clamp attached to the first end of the support member;

a channel in the shaft clamp aligned with the support member for receiving and gripping the shaft portion of the golf club to be supported;

a cross member attached generally perpendicularly to the second end of the support member for providing lateral support to the device wherein the cross member has a first end and a second end; and a spike wrench coupled to the first end of the cross member whereby a user of the device may access the spike wrench readily to permit a tightening of golf shoe spikes;

whereby the shaft portion of a golf club may be supported by the device to maintain the grip portion of the golf club above a surrounding portion of ground thereby supporting the golf club in an easily visible position, preventing the grip portion of the club from becoming wet or soiled, and easing retrieval of the golf club.

9. The golf club support device of claim 8 further comprising a cleaning brush coupled to the second end of the cross member whereby a user of the device may access the cleaning brush readily to permit a cleaning of golf shoes and golf clubs.

10. The golf club support device of claim 9 further comprising a ball mark repair tool removably coupled to the device whereby a user of the device may access the ball mark repair tool readily to permit a repairing of ball marks on a putting green.

11. The golf club support device of claim 9 further comprising a rubber sleeve surrounding at least a portion of the support member for providing a user with an improved grip on the golf club support device.

12. A device for supporting a golf club by engaging a shaft portion of the golf club to maintain a grip portion of the golf club that is located along the shaft portion of the golf club above a surrounding portion of ground on which a head portion of the golf club rests, the golf club support device comprising:

a generally rigid and elongate support member for providing an angular support for a golf club to be supported wherein the support member has a first end and a second end;

a shaft clamp attached to the first end of the support member;

a channel in the shaft clamp aligned with the support member for receiving and gripping the shaft portion of the golf club to be supported;

a cross member attached generally perpendicularly to the second end of the support member for providing lateral support to the device wherein the cross member has a first end and a second end; and a cleaning brush coupled to the second end of the cross member whereby a user of the device may access the cleaning brush readily to permit a cleaning of golf shoes and golf clubs;

whereby the shaft portion of a golf club may be supported by the device to maintain the grip portion of the golf club above a surrounding portion of ground thereby supporting the golf club in an easily visible position, preventing the grip portion of the club from becoming wet or soiled, and easing retrieval of the golf club.

13. A device for supporting a golf club by engaging a shaft portion of the golf club to maintain a grip portion of the golf club that is located along the shaft portion of the golf club above a surrounding portion of ground on which a head portion of the golf club rests, the golf club support device comprising:

a generally rigid and elongate support member for providing an angular support for a golf club to be supported wherein the support member has a first end and a second end;

a shaft clamp attached to the first end of the support member;

a channel in the shaft clamp aligned with the support member for receiving and gripping the shaft portion of the golf club to be supported.

a cross member attached generally perpendicularly to the second end of the support member for providing lateral support to the device wherein the cross member has a first end and a second end; and ball mark repair tool removably coupled to the device whereby a user of the device may access the ball mark repair tool readily to permit a repairing of ball marks on a putting green;

whereby the shaft portion of a golf club may be supported by the device to maintain the grip portion of the golf club above a surrounding portion of ground thereby supporting the golf club in an easily visible position, preventing the grip portion of the club from becoming wet or soiled, and easing retrieval of the golf club.

* * * * *